US007713579B2

(12) United States Patent
Ogawa et al.

(10) Patent No.: US 7,713,579 B2
(45) Date of Patent: May 11, 2010

(54) COATING APPARATUS, COATING METHOD, AND METHOD FOR MANUFACTURING OPTICAL FILM

(75) Inventors: Tomonari Ogawa, Fujinomiya (JP); Kazuhiko Nojo, Fujinomiya (JP)

(73) Assignee: FUJIFILM Corporation, Tokyo (JP)

( * ) Notice: Subject to any disclaimer, the term of this patent is extended or adjusted under 35 U.S.C. 154(b) by 438 days.

(21) Appl. No.: 11/729,889

(22) Filed: Mar. 30, 2007

(65) Prior Publication Data

US 2007/0231479 A1 Oct. 4, 2007

(30) Foreign Application Priority Data

Mar. 30, 2006 (JP) ..... 2006-095819

(51) Int. Cl.
*B05D 5/06* (2006.01)
*B05C 13/02* (2006.01)

(52) U.S. Cl. ..... 427/162; 118/200

(58) Field of Classification Search ..... 427/162
See application file for complete search history.

(56) References Cited

U.S. PATENT DOCUMENTS

| | | | | |
|---|---|---|---|---|
| 2,681,294 | A | 6/1954 | Beguin | |
| 2,761,791 | A | 9/1956 | Russell | |
| 2,941,898 | A | 6/1960 | Wynn | |
| 3,508,947 | A | 4/1970 | Hughes | |
| 3,526,528 | A | 9/1970 | Takahashi et al. | |
| 5,518,783 | A | 5/1996 | Kawata et al. | |
| 5,568,290 | A | 10/1996 | Nakamura | |
| 5,747,121 | A | 5/1998 | Okazaki et al. | |
| 5,793,455 | A | 8/1998 | Nakamura | |
| 5,853,801 | A | 12/1998 | Suga et al. | |
| 6,064,457 | A | 5/2000 | Aminaka | |
| 6,207,263 | B1 | 3/2001 | Takematsu et al. | |
| 6,348,960 | B1 | 2/2002 | Etori et al. | |
| 6,524,388 | B1 * | 2/2003 | Yamada et al. | 118/663 |
| 2001/0021446 | A1 | 9/2001 | Takematsu et al. | |
| 2002/0022092 | A1 * | 2/2002 | Yoshida | 427/355 |
| 2004/0247794 | A1 * | 12/2004 | Tokimasa et al. | 427/421.1 |
| 2005/0008537 | A1 * | 1/2005 | Mosoiu et al. | 422/56 |
| 2005/0228152 | A1 * | 10/2005 | Starry et al. | 526/247 |
| 2006/0040079 | A1 * | 2/2006 | Sekihara | 428/38 |
| 2007/0186850 | A1 * | 8/2007 | Matsuoka et al. | 118/719 |

FOREIGN PATENT DOCUMENTS

| | | | |
|---|---|---|---|
| EP | 0646829 | A1 | 4/1995 |
| EP | 0676652 | A2 | 10/1995 |
| EP | 0726486 | A2 | 8/1996 |
| EP | 0774683 | A2 | 5/1997 |
| EP | 0926533 | A2 | 6/1999 |

(Continued)

OTHER PUBLICATIONS

Harasaki, "Coating Engineerings," Asakura Publishing Co., Ltd., pp. 253-255, 1971.

*Primary Examiner*—Shamim Ahmed
(74) *Attorney, Agent, or Firm*—Sughrue Mion, PLLC

(57) ABSTRACT

The coating apparatus includes a base for supporting a slot die, wherein the base has a height of not more than 5 m from a ground level, and a mean cross sectional area of not less than 3 $m^2$ in terms of a horizontal direction.

10 Claims, 7 Drawing Sheets

FOREIGN PATENT DOCUMENTS

| | | | |
|---|---|---|---|
| EP | 0926533 | B1 | 8/2001 |
| EP | 1189100 | A1 | 3/2002 |
| EP | 1207408 | A2 | 5/2002 |
| EP | 0646829 | B1 | 7/2002 |
| EP | 0774683 | B1 | 3/2003 |
| EP | 1189100 | B1 | 4/2003 |
| EP | 0726486 | B1 | 4/2005 |
| GB | 837095 | | 6/1960 |
| JP | 07-191217 | A | 7/1995 |
| JP | 07-267902 | A | 10/1995 |
| JP | 07-281028 | A | 10/1995 |
| JP | 07-306317 | A | 11/1995 |
| JP | 08-005837 | A | 1/1996 |
| JP | 08-050206 | A | 2/1996 |
| JP | 08-095034 | A | 4/1996 |
| JP | 08-160431 | A | 6/1996 |
| JP | 09-073016 | A | 3/1997 |
| JP | 09-073081 | A | 3/1997 |
| JP | 09-152509 | A | 6/1997 |
| JP | 09-157855 | A | 6/1997 |
| JP | 09-197397 | A | 7/1997 |
| JP | 10-206603 | A | 8/1998 |
| JP | 11-038202 | A | 2/1999 |
| JP | 11-038208 | A | 2/1999 |
| JP | 11-316378 | A | 11/1999 |
| JP | 11-326601 | A | 11/1999 |
| JP | 2000-199809 | A | 7/2000 |
| JP | 2002-107512 | A | 4/2002 |
| JP | 2002-243906 | A | 8/2002 |
| JP | 2002-327310 | A | 11/2002 |
| JP | 2003-149413 | A | 5/2003 |

* cited by examiner

COATING APPARATUS, COATING METHOD, AND METHOD FOR MANUFACTURING OPTICAL FILM

BACKGROUND OF THE INVENTION

1. Field of the Invention

The present invention relates to a coating apparatus, a coating method, and a method for manufacturing an optical film, and in particular to a technology to suppress vibration of a coating apparatus.

2. Description of the Related Art

Apparatuses of a type which uses a die coater (slot die) for discharging a coating solution from a manifold via a slot have been widely used as a coating apparatus for coating a surface of a web (supporting medium) with a coating film (thin film) having a desired thickness. Such a die coater has several types including a slide coater, a fountain coater, and an extrusion coater, and an appropriate type of die coater depending on an application is used to form a film (coating film) such as a high quality optical film.

In such coating apparatuses, a coating section and a web are usually fixedly mounted to a vibration resistant base so that vibration exerted on the coating section and the web can be suppressed.

In order to form a coating film having high quality by a coating apparatus which is precision measuring equipment, it is preferred to suppress vibration of the coating apparatus as much as possible so as to prevent vibration that may lead a poor surface profile of a coating film such as stepped unevenness; however, there has not been found any document so far that discloses or suggests a specific base structure for effectively suppressing vibration exerted on a coating apparatus.

The present invention has been contrived in view of the above situation, and one object of the present invention is to provide a coating apparatus which includes a base for effectively suppressing vibration, a coating method for effectively suppressing vibration, and a method of manufacturing of an optical film, such as a coating film which is obtained by using the coating apparatus or the coating method.

SUMMARY OF THE INVENTION

One aspect of the present invention relates to a coating apparatus including a base for supporting a slot die, wherein the base has a height of not more than 5 m from a ground level, and a mean cross sectional area of not less than 3 $m^2$ in terms of a horizontal direction.

In this aspect of the present invention, the above-ground section of the base which is positioned above the ground level has a limited height and a sufficient average horizontal cross sectional area, which effectively suppresses vibration of the base and the slot die.

The term "slot die" as used herein represents a concept including general coating apparatuses in which a coating solution is discharged via a slot which has a relatively narrow width, and includes a so-called die coater. The term "ground level" as used herein means a level of a place where the base is fixed, and means the level of the ground surface for example. Also, the term "average horizontal cross sectional area" as used herein means an average value of a cross sectional area in the horizontal direction.

Preferably, a top portion of the base shows acceleration of not more than 0.3 Gal at a frequency of not less than 5 Hz according to a root-mean-square value obtained by a ⅓ octave-band peak hold analysis of a 60-second sampling data.

In this aspect of the present invention, vibration of the base and the slot die can be effectively suppressed.

Preferably, the base is made of concrete or reinforced concrete.

In this aspect of the present invention, the base can adequately support the slot die.

Preferably, the base supports both an applicator which includes the slot die, and a coating roll apparatus which supports a medium to which a coating solution ejected from the slot die is applied.

In this aspect of the present invention, the base can effectively suppress vibration of the slot die as well as vibration of the coating roll apparatus. This enables the slot die to accurately apply a coating solution to the medium which is supported by the coating roll apparatus.

Preferably, the coating apparatus further includes at least one of a vibration damping apparatus and a vibration isolation apparatus which is interposed between the slot die and the base.

In this aspect of the present invention, the vibration damping apparatus or the vibration isolation apparatus further effectively suppresses vibration of the base and the slot die. Any appropriate apparatus may be used as the vibration damping apparatus or the vibration isolation apparatus.

Preferably, the slot die is a die coater or a slide coater.

In cases where a die coater or a slide coater is used, it is desirable to suppress the vibration as far as possible in order to accurately form a coating film. Hence, a coating apparatus according to this aspect of the present invention is particularly effective.

Another aspect of the present invention relates to a coating method including the steps of: preparing a medium; and forming a coating film on the medium by using any one of the above-described coating apparatuses.

In this aspect of the present invention, vibration of the base and the slot die can be effectively suppressed.

Another aspect of the present invention relates to a method for manufacturing an optical film including the steps of: forming a coating film on a medium by using any one of the above-described coating apparatuses; and manufacturing an optical film including the coating film.

In this aspect of the present invention, a coating film which is accurately formed on a medium by using any one of the above-described coating apparatuses is used, and accordingly a high quality optical film can be manufactured.

Preferably, the optical film is an anti-reflection film.

In manufacturing a highly functional film such as an anti-reflection film, the film needs to be accurately manufactured. Hence, coating apparatuses and coating methods according to embodiments of the present invention are particularly suitable for manufacturing such a highly functional film.

In an apparatus and a method for applying a coating solution according to embodiments of the present invention, a slot die is supported by a base to suppress vibration of the slot die, and therefore a coating solution can be accurately discharged from the slot die. Also, a high quality optical film can be produced by using a coating film manufactured by using a coating apparatus or a coating method according to embodiments of the present invention.

DETAILED DESCRIPTION OF THE PREFERRED EMBODIMENTS

With reference to the accompanying the drawings, embodiments of the present invention are individually explained in detail below.

First Embodiment

Figure 1:
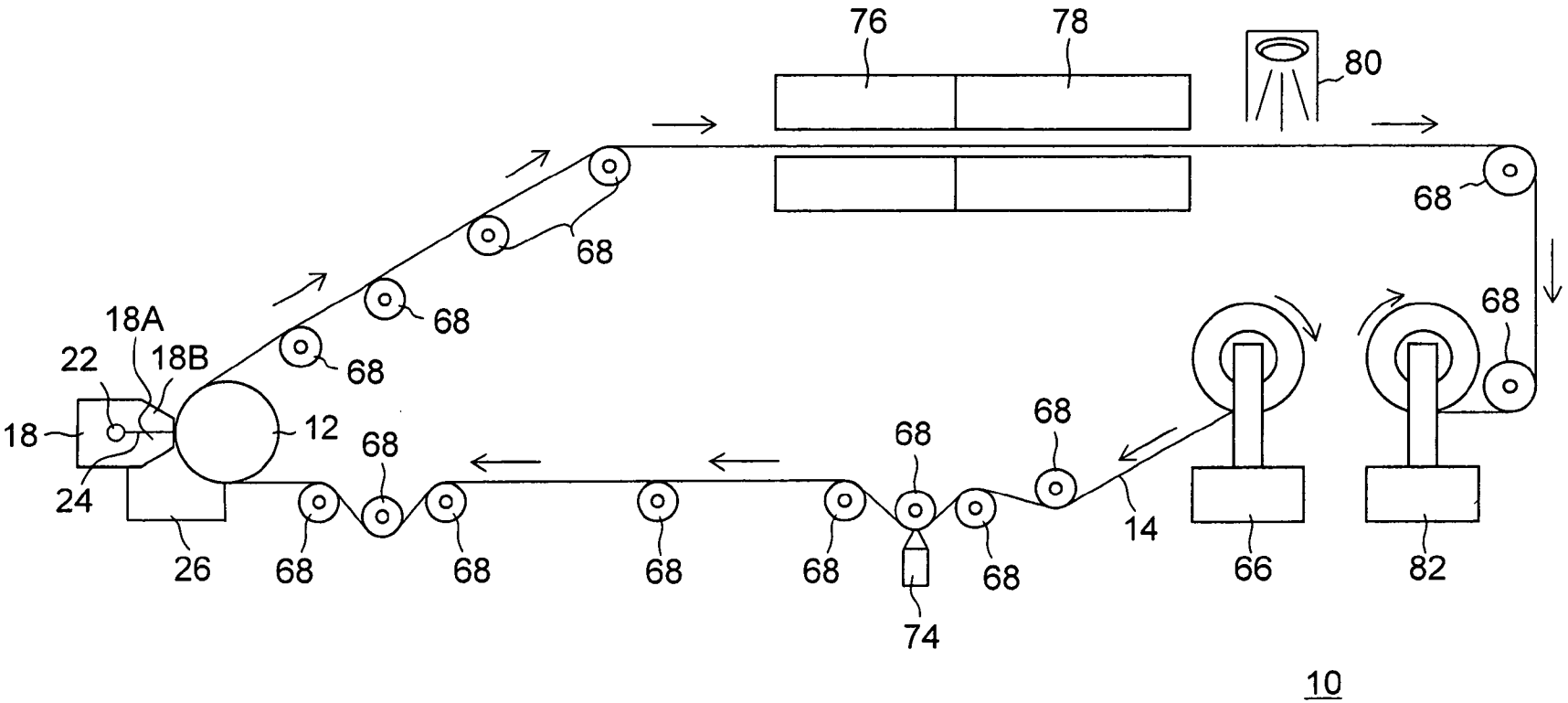
FIG. 1 is a view showing an entire structure of a manufacturing line of an optical film (a slot die coater type coating system)

FIG. 1 is a view showing an entire structure of a manufacturing line of an optical film (a slot die coater type coating system 10). Each arrow in FIG. 1 shows the running direction of a web 14. To simplify the illustration of the slot die coater type coating system 10, with respect to a plurality of pass rollers 68 for conveying the web 14, only pass rollers 68 that are disposed at typical positions are shown.

The slot die coater type coating system 10 of the present embodiment includes, from upstream to downstream, a feeding device 66, a dust collector 74, a backup roller 12, an extrusion type die coater (slot die) 18, a drying apparatus 76, a heating apparatus 78, an ultraviolet irradiating unit 80, and a winder 82 in series. The terms "upstream" and "downstream" as used herein are used on the basis of the running direction of the web 14.

The feeding device 66 sends the web 14 which is a transparent supporting medium including a polymer layer which is formed in advance, toward the downstream side. The dust collector 74 removes foreign materials, such as dust, on a surface of the web 14.

The backup roller 12 supports and conveys the web 14, and the die coater 18 discharges a coating solution toward the web 14 supported and conveyed by the backup roller 12, in order to form a coating film on the web 14. The die coater 18 and the backup roller 12 are explained in detail later.

The drying apparatus 76 and the heating apparatus 78 form a zone for drying the coating film formed on the web 14. In the drying apparatus 76, a solvent of the coating film (coating layer) on the web 14 is evaporated while the surface of the coating film (coating layer) on the web 14 is sealed and controlled by a gas layer. In order to seal a surface of the coating film with a gas layer, the gas is preferably caused to move along the surface of the coating film at a speed of −0.1 nm/sec to +0.1 m/sec relative to a moving speed of the coating film. In order to evaporate the solvent under control, the drying is preferably completed while the content of the solvent in the coating film reduces at a speed which is proportional to time. The heating apparatus 78 can produce heat to remove a solvent or to cure the film, as needed.

The evaporation of a solvent by using the drying apparatus 76 and the heating apparatus 78 is preferably conducted with a cover being provided thereto. Rectified air, uniform air, and the like may be used as drying air. The evaporated solvent may be condensed and removed by using a cooling condenser which is disposed opposing to a surface of the coating film.

The ultraviolet irradiating unit 80 radiates ultraviolet light onto the coating film by using an ultraviolet lamp to cause monomers in the coating film to be cross linked so that a desirable polymer is formed. The winder 82 reels and collects the web 14 on which the polymerized coating film (coating layer) is placed.

Another heating zone may be provided to cure the coating film by heating, depending on the components of the coating film, so that the coating film is desirably cured and cross linked. Alternatively, as a separate processing from the system 10, other processing such as heating process may be provided to the coating film on the web 14.

Between the components in the slot die coater type coating system 10, a plurality of pass rollers 68 are provided to convey the web 14 from the upstream side to the downstream side. The positions and number of pass rollers 68, the distances between the rotation centers of the adjacent pass rollers 68, and the like are conveniently adjusted as needed.

In the above-described slot die coater type coating system 10, the backup roller 12 and the pass rollers 68 function as guide rollers to convey the web 14. Other components may be incorporated into the slot die coater type coating system 10 as needed. For example, in order to manufacture an optical compensation film, a rubbing apparatus for orienting a liquid crystal part of the coating film (for adjusting the orientation of a liquid crystal part of the coating film) may be provided on the upstream side and/or on the downstream side of the dust collector 74 (before and/or after the dust collector 74).

Next, the die coater 18 and the backup roller 12 are explained below.

Figure 2:
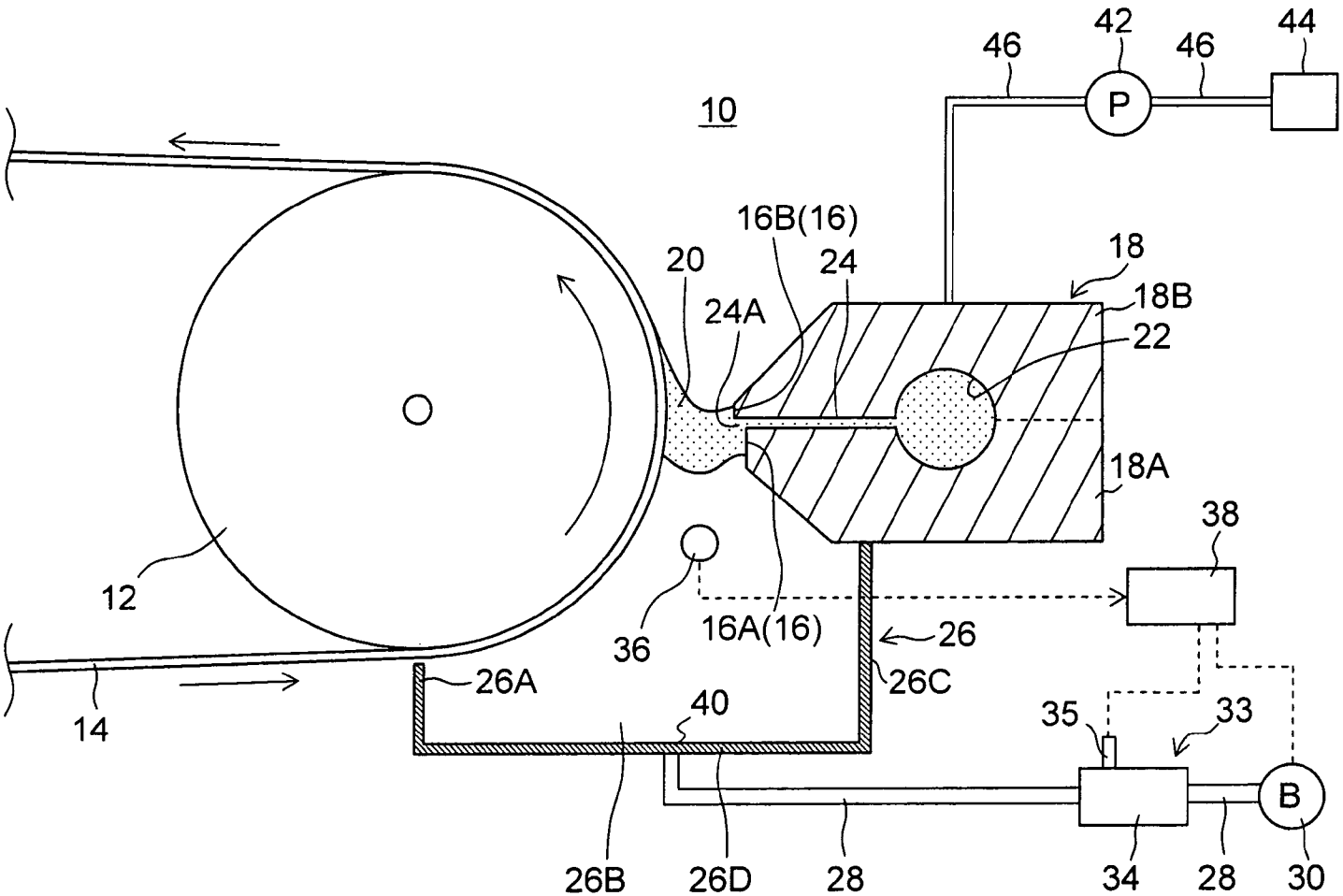
FIG. 2 is a structural view showing a die coater, a backup roller, and accessories thereof.

FIG. 2 is a structural view illustrating the die coater 18, the backup roller 12, and accessories thereof. An arrow that is near the backup roller 12 and the web 14 in FIG. 2 indicates "a direction in which the web 14 is conveyed by the backup roller 12", that is "the running direction of the web 14" in the present embodiment. For an easier understanding, each component illustrated in FIG. 2 is shown in a different size and a different direction from those of the actual component, and components illustrated in FIG. 2 corresponds to those illustrated in FIG. 1.

In the present embodiment, a coating solution is discharged through a slot 24 of the die coater 18 toward a surface of the web (supporting medium) 14 which is continuously running while being supported by the backup roller 12, so that a bead 20 of the coating solution is formed between the die coater 18 and the web 14 as a liquid bridge. With an inside of a decompression chamber 26 which is a space on the web upstream side of the bead 20 being decompressed, the coating solution of the bead 20 is applied to the surface of the continuously running web 14, to form a coating film (coating layer) on the web 14.

Herein, based on a position where a coating solution is applied by the die coater 18 (hereinafter, referred to also as "coating position"), the term "web upstream" specifies a part upstream of the coating position and the term "web downstream" specifies a part downstream of the coating position, in terms of the running direction of the web 14. Hence, for the horizontal type die coater 18 shown in FIG. 2, the lower side of the bead 20 is "the web upstream side", and the upper side of the bead 20 is "the web downstream side". And the width direction of the web which is perpendicular to the conveying direction of the web is referred to as "the web width direction".

Figure 3:
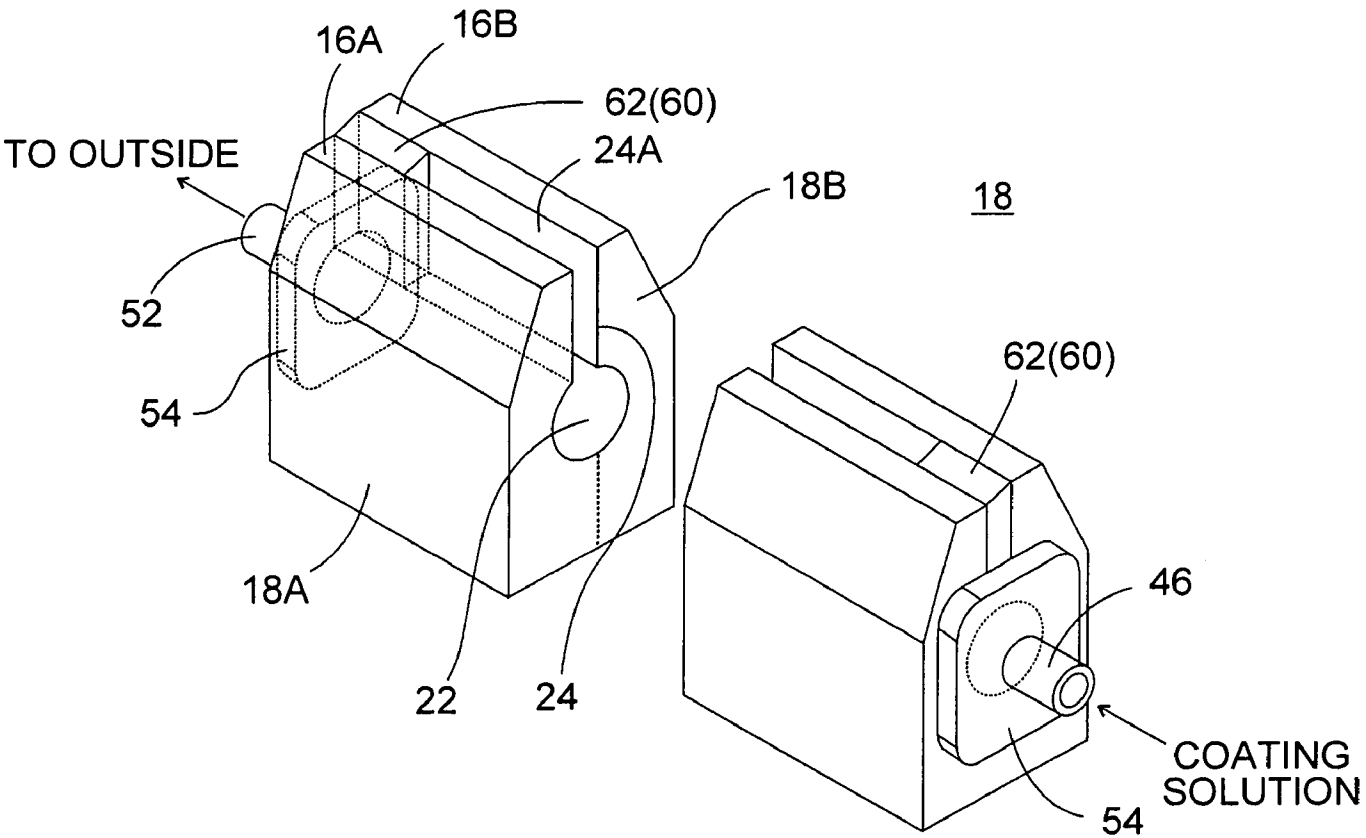
FIG. 3 is a perspective view showing a die coater which is cut at its middle.

FIG. 3 is a perspective view showing the die coater 18 which is cut at its middle.

The die coater 18 includes: a manifold 22 formed inside the body, and the slot 24 which extends from the manifold 22 to the distal end of the die coater 18. The die coater 18 is constituted by an upstream side die block 18A and a downstream side die block 18B, and the manifold 22 and the slot 24 forms a part of the boundary between the upstream side die block 18A and the downstream side die block 18B. This multi-block structure of the die coater 18 improves the accuracy in manufacturing the die coater 18, and also makes its post-processing such as cleaning easier. The specific shape and size of the die coater 18 are set on the basis of its weight, an environment in use, a temperature of a coating solution, a manufacturing specification limit, and the like.

The coating solution which is supplied to the die coater 18, is sent to the manifold 22. The manifold 22 is a liquid reservoir for spreading the coating solution in the direction of the coating width (the web width direction), and extends in the web width direction (the longitudinal direction thereof). The manifold 22 in the present embodiment has a substantially circular cross section, and forms a hollow section having the substantially uniform cross section over the entire length in the web width direction. The manifold 22 is set to have an effective length in the web width direction which is equal to or somewhat longer than the coating width of the web 14. The manifold 22 is also referred to as a "pocket".

Both ends of the body of the die coater 18 in terms of the web width direction are provided with blocking plates 54 to prevent a coating solution from leaking from the manifold 22 to the outside. The manifold 22 is connected with a coating solution exhaust pipe 52 which serves to withdraw the coating solution from the manifold 22. A coating solution supply pipe 46 and the coating solution exhaust pipe 52 pass through the blocking plates 54 respectively, and are connected with the manifold 22. In the present embodiment, the supplying of the coating solution to the manifold 22 and the elimination of the coating solution from the manifold 22 are carried out through the coating solution supply pipe 46 and the coating solution exhaust pipe 52; however, the manner of the supplying and elimination of the coating solution is not limited to the above-mentioned manner.

The slot 24 forms a narrow flow path for the coating solution from the manifold 22 to the slot distal end, and the coating solution is discharged through an opening 24A at the distal end of the die coater 18 to form the bead 20 of the coating solution between the die coater 18 and the web 14. The slot 24 usually has an opening width on the order of 0.01 mm to 0.5 mm, and as for the web width direction, has a length equal to or more than the coating width of the coating solution with respect to the web 14. The distal end of the slot 24 is formed to have an angle of 30 degree to 90 degree with respect to a tangent line of the backup roller 12 in the web width direction. The length of the flow path of the slot 24 which extends from the manifold 22 toward the web 14 can be set on the basis of conditions including a liquid composition, a physical property, a flow rate in supplying, a fluid pressure in supplying, and the like, of the coating solution. The slot 24 is preferably set to have the flow path having a length which allows the coating solution discharged through the opening 24A of the slot 24 to have a substantially uniform flow rate and a fluid pressure in terms of the web width direction.

At both ends of the slot 24 in terms of the web width direction, width adjusting plates 60 are inserted in the slot 24, and each of the width adjusting plates 60 is close contact with the upstream side die block 18A and the downstream side die block 18B which form the walls of the slot 24. The width adjusting plates 60 are members to adjust a coating width of the coating solution discharged through the opening 24A of the slot 24, and are arranged so that the opening 24A has a length that is substantially equal to or less than the coating width in the web width direction (the longitudinal direction). Preferably, from the viewpoint of stabilization of the coating conditions of the coating solution near the width adjusting plates 60, the width adjusting plates 60 are formed of a particular material or is subjected to a surface treatment so that the wettability of the coating solution to the width adjusting plates can be controlled. For example, preferably the width adjusting plates 60 may be formed of Teflon (R) or New Light (R), or may be metal plates having a polymer coating such as a fluorocarbon resin, so that the contact angle of the width adjusting plates 60 with the coating solution is controlled to be 30 degrees or more.

The distal end of the die coater 18 is formed in a tapered shape to have a tip which is called a lip land 16, as shown in FIG. 2. Herein, the lip land 16 on the web upstream side of the slot 24 (on the lower side in FIG. 2) is called an upstream lip land 16A, and the lip land 16 on the web downstream side of the slot 24 (on the upper side in FIG. 2) is called a downstream lip land 16B.

The die coater 18 in the present embodiment has an overbite structure, and the downstream lip land 16B is disposed at a position closer to the web 14 which is wound on the backup roller 12, compared to the position of the upstream lip land 16A. This overbite structure is generally uniformly provided to the die coater 18 over the entire length thereof in the web width direction. When the die coater 18 has such an overbite structure, a structure in which the downstream lip land 16B is relatively narrow, or a low lip clearance structure in which a space between the lip land 16 and the web 14 is narrow, then the pressure drop of the coating solution on the downstream side of bead 20 can be reduced, and the decompression value in the decompression chamber 26 can be reduced. Therefore, these structures reduce the variations of the bead 20, and allow the coating solution to be applied on the web 14 in a stable manner, resulting in a coating film having a highly accurate surface profile.

The manifold 22 is connected with a coating solution tank 44 for storing the coating solution, via the coating solution supply pipe 46. The coating solution supply pipe 46 is provided with a coating solution pump 42 that sends the coating solution from the coating solution tank 44 to the manifold 22.

Below the distal end of the die coater 18 having the above-described configuration, the decompression chamber 26 is provided for decompressing the space on the web upstream side of the bead 20. The decompression chamber 26 is configured to have a box-like shape surrounded by a back plate 26A, two side plates 26B, a rear plate 26C, and a bottom plate 26D to form a space therein.

The back plate 26A is disposed on the most upstream side of the decompression chamber 26 in terms of the web conveying direction, and is arranged to extend in the width direction of the web 14. The two side plates 26B are arranged perpendicular to the back plate 26A, and form the both side walls of the decompression chamber 26. Each of the side plates 26B has an edge part (not shown) which is close to the backup roller 12 and has approximately the same curvature as that of the backup roller 12. The rear plate 26C is disposed generally parallel to the back plate 26A below the die coater 18. The bottom plate 26D forms the bottom part of the decompression chamber 26, and is bonded to the back plate 26A, the side plates 26B, and the rear plate 26C at the edge parts thereof.

Gaps which each have a predetermined size are formed "between the back plate 26A and the web 14" and "between each side plate 26B and the web 14" respectively. These gaps mainly constitute "the gap between the backup roller 12 (the web 14) and the decompression chamber 26" and "the gap between the die coater 18 and the decompression chamber 26", and the external air (air) flows into the decompression chamber 26 through these gaps. The flow rate of the air which flows into the decompression chamber 26 through these gaps depends on the decompression level in the decompression chamber 26, and specifically the flow rate is determined depending on the flow rate of the sucked air through an air inlet port 35 and the flow rate of the exhaust air through a blower 30.

The bottom plate 26D has an inlet port 40 formed therein, and the inlet port 40 is connected with an air supply pipe 28. The decompression chamber 26 is connected with the blower 30 via the inlet port 40 and the air supply pipe 28, and the air supply pipe 28 between the decompression chamber 26 and the blower 30 is provided with a buffer apparatus 33. Thus, the decompression chamber 26, the buffer apparatus 33, and the blower 30 are provided in series via the air supply pipe 28, and a decompressing apparatus is formed by these components.

The blower 30 sucks the air in the decompression chamber 26 via the inlet port 40 and the air supply pipe 28 to make the pressure in the decompression chamber 26 negative. The blower 30 in the present embodiment is of an inverter type. The blower 30 is able to conveniently vary the air inlet flow rate and control the air outlet flow rate within a range of 0.5 $m^3$ to 5 $m^3$ per hour (0.008 $m^3$/min to 0.08 $m^3$/min).

Next, a mechanism for controlling a distance between the die coater 18 and the backup roller 12 (the web 14) is explained below.

Figure 4:
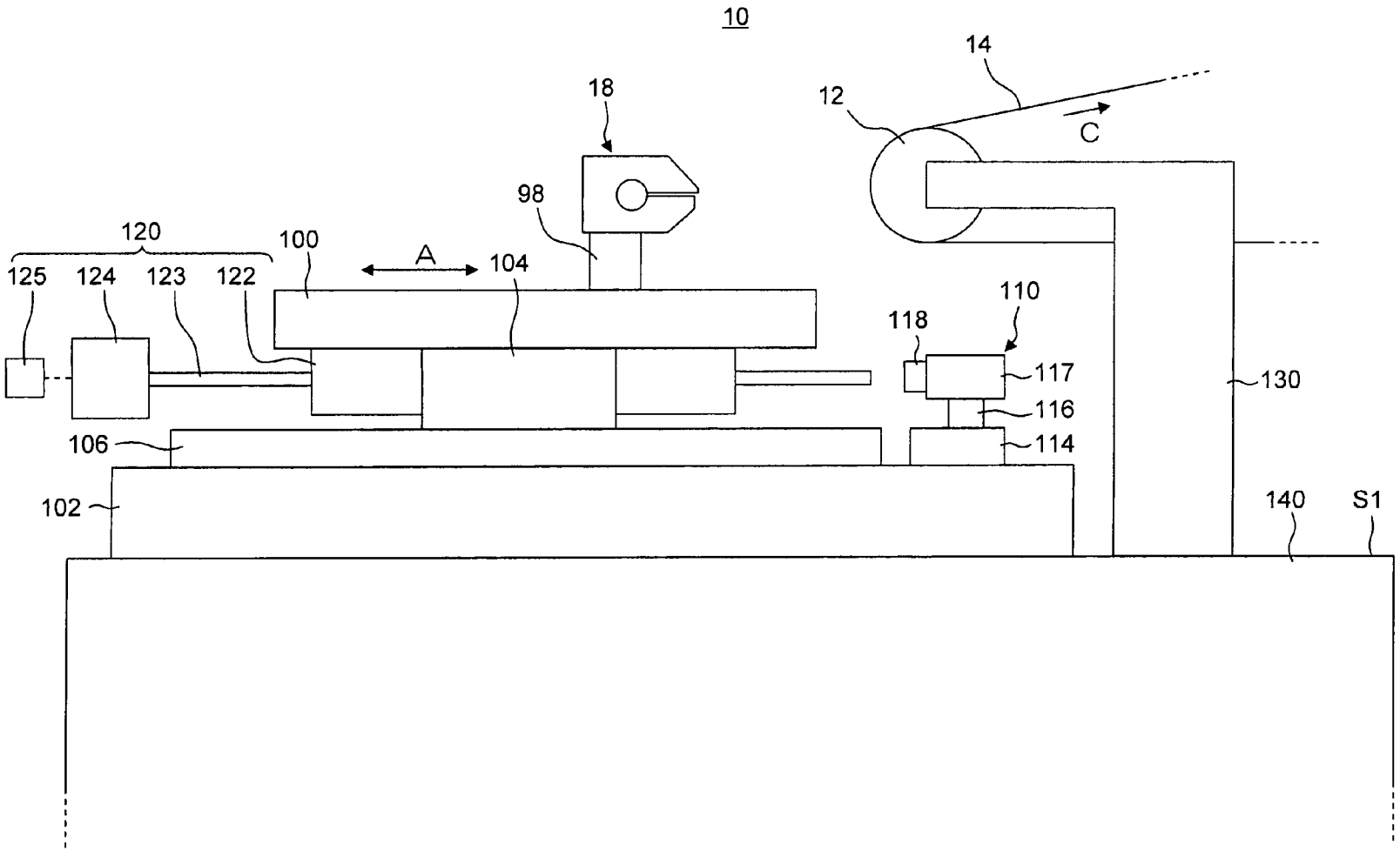
FIG. 4 is a view showing the structure of a die coater and a backup roller in a first embodiment as seen from a side thereof.

FIG. 4 is a view showing a structure of the die coater 18 and the backup roller 12 in the first embodiment as seen from a side thereof.

The die coater 18, the backup roller 12, a stopper 110 controlling the distance between the die coater 18 and the backup roller 12 (the web 14), and the like are mounted on the base 140.

The backup roller 12 on which the web 14 is wound is fixedly supported by the base 140 via a roller pedestal 130.

A lower pedestal 102, slide guide sections 106, slide sections 104, a movable table 100, and a die supporting section 98 are provided in series between the die coater 18 and the base 140.

The lower pedestal 102 is a pedestal to achieve a stable fixed support on the base 140, and is provided directly on the base 140. The slide guide sections 106 are members for guiding a slide of the slide sections 104. In the present embodiment, two slide guide sections 106 are arranged side by side in terms of a direction perpendicular to the moving direction of the die coater 18 (see an arrow A in FIG. 4) on the lower pedestal 102, and each of the slide guide sections 106 extends in the moving direction of the die coater 18. The two slide sections 104 are arranged side by side in terms of a direction perpendicular to the moving direction of the die coater 18 (see the arrow A in FIG. 4) under the movable table 100 at positions relative to the slide guide sections 106. Each of the slide sections 104 is slidably fit with the corresponding slide guide section 106, which allows the slide sections 104 to slide along the slide guide sections 106 together with the movable table 100.

The movable table 100 is a table for fixedly supporting the die coater 18 via the die supporting section 98, and slides together with the slide sections 104. The die supporting section 98 is a member for fixing the die coater 18 on the movable table 100.

A driving device 120 that serves as a driving source which causes the die coater 18 to slide, is provided below the movable table 100. The driving device 120 includes a stopper receiving section 122 fixed to the movable table 100, a ball screw 123 passing through the stopper receiving section 122, a servomotor 124 which axially rotates the ball screw 123, and a position detecting device 125 which determines a position of the movable table 100.

The stopper receiving section 122 is screwed with the ball screw 123, and moves in the moving direction of the die coater 18 (the direction shown by the arrow A in FIG. 4) as the ball screw 123 axially rotates. The ball screw 123 extends in the moving direction of the die coater 18, and the axially rotation thereof causes the stopper receiving section 122, the movable table 100, the die supporting section 98, and the die coater 18 to move in the direction shown by the arrow A. The position detecting device 125 detects an actual position of the movable table 100, and sends the detected result to the servomotor 124. Any device which is able to detects a position of the movable table 100 can be used as the position detecting device 125, and the position detecting device 125 may be disposed at a suitable position depending on its detection approach, without any particular limitation. The servomotor 124 performs a feedback control of the axial rotation of the ball screw 123 on the basis of the detected result from the position detecting device 125, and precisely controls the positions of the movable table 100, the die coater 18, and the like. However, the structure of the driving device 120 is not limited to the above.

On the lower pedestal 102, a first stopper 110 is provided for limiting the movement of the stopper receiving section 122. The first stopper 110 is disposed at a position closer to the backup roller 12, compared to that of the stopper receiving section 122 (on the right side of FIG. 4). The first stopper 110 may be disposed at any position in terms of a direction perpendicular to the paper surface of FIG. 4 (the arrow A in FIG. 4), and may be disposed generally toward the central part of the stopper receiving section 122 for example.

The first stopper 110 has a stopper pedestal 114 which is attached to the lower pedestal 102, a stopper support section 116 and a contact and support section 117 both of which are mounted on the stopper pedestal 114, and a contact section 118 attached to the surface of the contact and support section 117 which is facing to the stopper receiving section 122. The contact section 118 which directly contacts with the stopper receiving section 122 is desirably formed of a material having high rigidity, and has a structure having high rigidity.

As described above, the mechanism for controlling the distance between the die coater 18 and the backup roller 12 (the web 14) first precisely controls the axial rotation of the ball screw 123 by using the servomotor 124, according to a target position to which the stopper receiving section 122 moves. This causes the stopper receiving section 122 to precisely move to the target position, which allows the movable table 100 and the die coater 18 to move to desired positions. Then, a coating solution is discharged from the die coater 18 disposed at the desired position, toward the web 14 wound on the backup roller 12, so as to form a coating film on the web 14.

Figure 5:
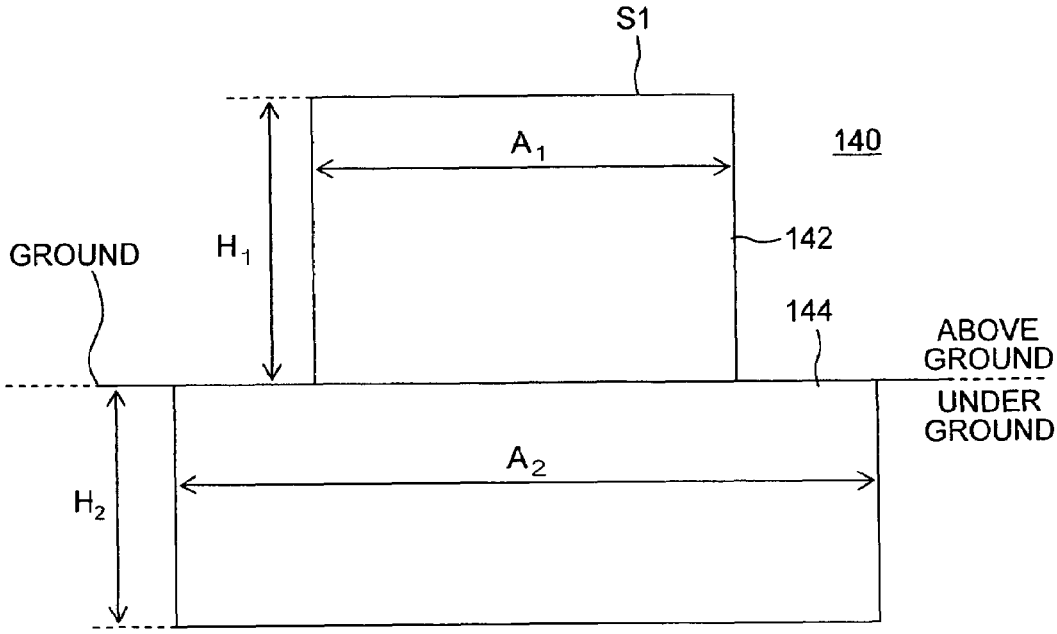
FIG. 5 is a cross sectional view showing a base in the first embodiment as seen from a side thereof.
Figure 6:
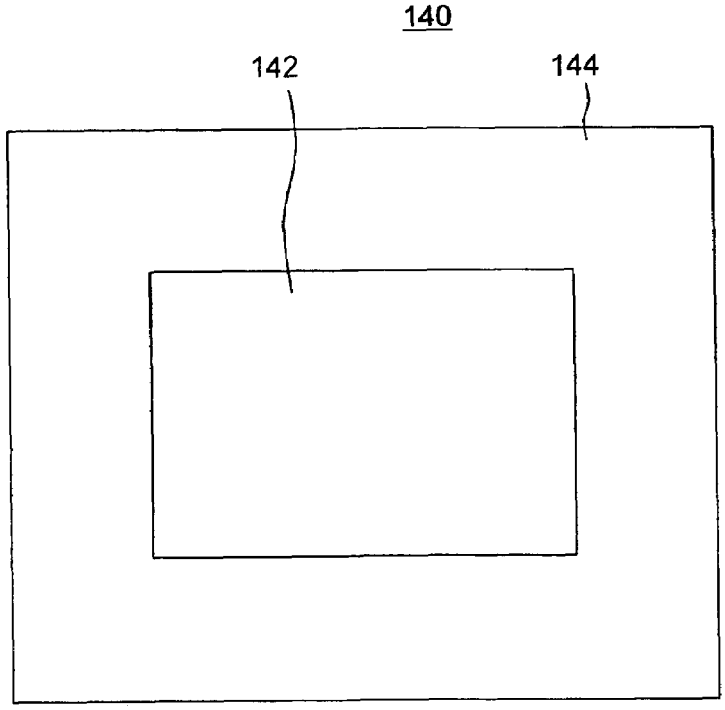
FIG. 6 is a view showing the base in the first embodiment as seen from a top thereof.

Next, the structure of the base 140 is explained below. FIG. 5 is a cross sectional view showing the base 140 in the first embodiment as seen from a side thereof. FIG. 6 is a view showing the base 140 in the first embodiment as seen from a top thereof.

The base 140 is constituted by an above-ground section 142 which has a shape of rectangular parallelepiped and projects upward from the ground level, and an underground section 144 which is buried under the ground. The above-ground section 142 has a generally constant cross sectional area (horizontal cross sectional area) $A_1$, and the average of the horizontal cross sectional area $A_1$ is set to be 3 $m^2$ or more. Also, the height $H_1$ of the above-ground section 142 is set to be 5 m or less. Meanwhile, the underground section 144 also has a generally constant cross sectional area (horizontal cross sectional area) $A_2$, and the average of the horizontal cross sectional area $A_2$ is set to be 5 $m^2$ or more. The depth $H_2$ of the underground section 144 is set to be 2 m or more. The base 140 is formed of concrete or reinforced concrete (steel reinforced concrete), and other appropriate materials may be used depending on the conditions of the usage environmental of the base 140, and the like.

The base 140 has an upper surface $S_1$ on which the die coater 18 and the backup roller 12 are mounted (see FIG. 4).

The inventors of the present invention have gained the following new knowledge, that as shown in the following Examples. More specifically, the higher the height $H_1$ of the above-ground section 142 of the base 140 is, and also the smaller the cross sectional area of the above-ground section 142, the vibration of the die coater 18, the backup roller 12, and other components mounted on the base 140 cannot be easily suppressed and tends to increase. Also, the inventors have found that the suppression of vibration within a low frequency range of 100 Hz or less which is caused in the die coater 18, the backup roller 12, and other components mounted on the base 140, and the elimination of a natural frequency which is particular to each component are particularly effective to accurately apply a coating solution to the web 14.

Specifically, the inventors have gained new knowledge that when the height $H_1$ of the above-ground section 142 of the base 140 is set to be 5 m or less and also the average horizontal cross sectional area $A_1$ of the above-ground section 142 is set to be 3 $m^2$ or more, vibration of the components on the base 140 can be effectively suppressed. Moreover, the inventors have gained new knowledge that, according to the rms value (root-mean-square value) obtained by a ⅓ octave-band peak hold analysis of a 60-second sampling data, it is preferred to control the positions of the components disposed on the base 140, the weights of the components, and the like so that the top portion (upper surface $S_1$) of the base 140 in operation has acceleration of 0.3 Gal or less at a frequency of 5 Hz or more in all of the X-axis, Y-axis, and Z-axis directions. The inventors confirmed the fact that the knowledge is preferable, by using a tripartite graph which shows the relationship between the acceleration, the speed, and the vibration value and the frequency.

Therefore, the slot die coater type coating system 10 which satisfies the above conditions effectively suppresses vibration of the die coater 18, the backup roller 12, and other components mounted on the base 140. In this way, surface defects such as stepped unevenness of a coating film which is formed on the web 14 can be reduced, and a high quality coating film can be produced. Since the coating film which is produced by using the above-mentioned apparatus has a very good surface profile, the coating film is particularly useful in the field of optical films such as an anti-reflection film.

Second Embodiment

In a second embodiment of the present invention, the same members as or similar members to those in the above-described first embodiment are designated with the same reference numbers, and the detailed descriptions thereof are omitted below.

Figure 7:
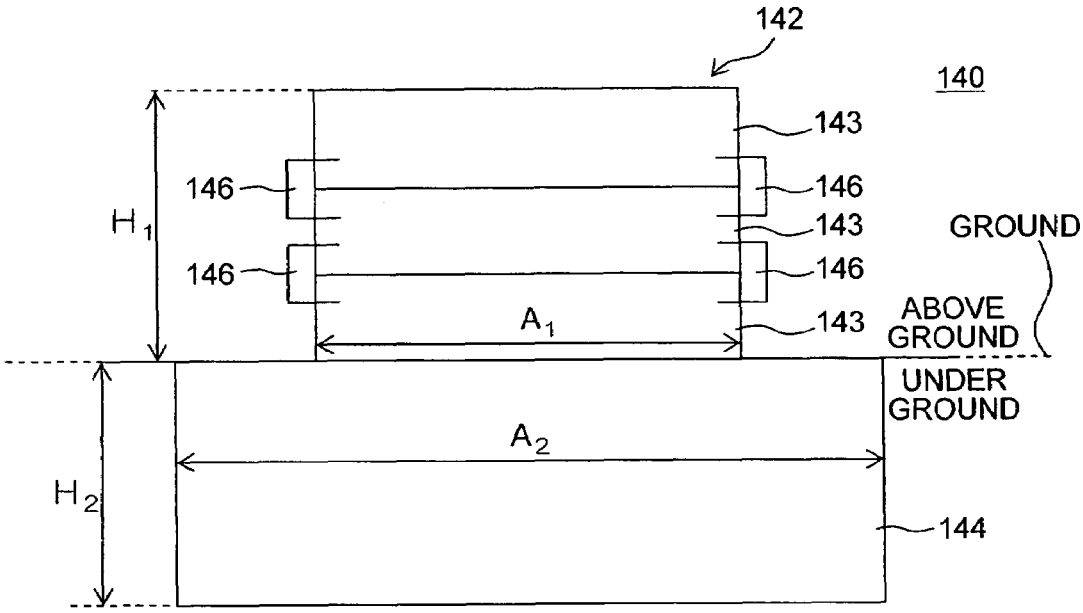
FIG. 7 is a cross sectional view showing a base in a second embodiment as seen from a side thereof.
Figure 8:
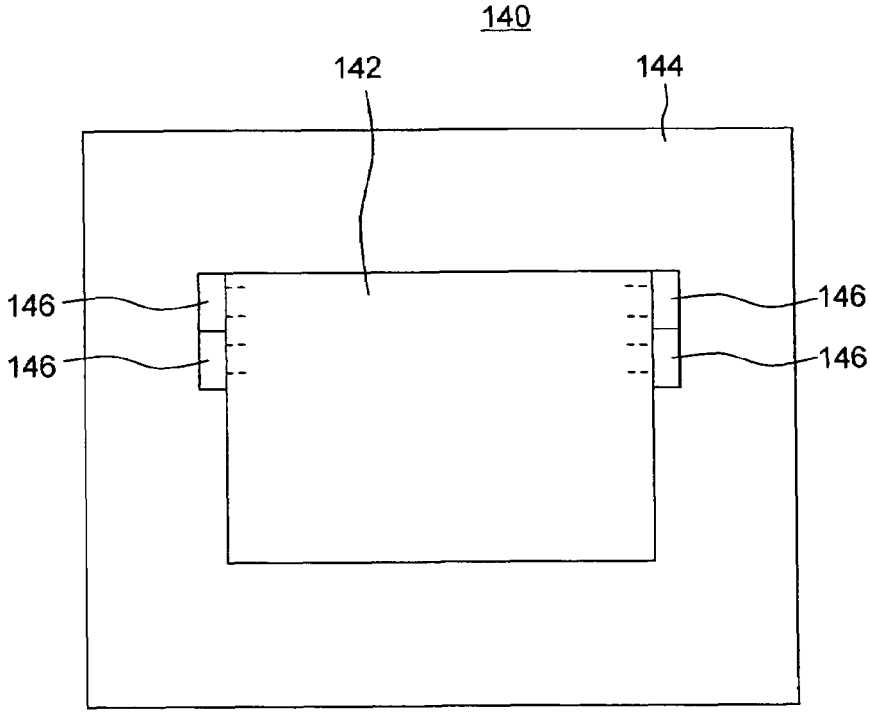
FIG. 8 is a view showing the base in the second embodiment as seen from a top thereof.

FIG. 7 is a cross sectional view showing the base 140 in the second embodiment as seen from a side thereof. FIG. 8 is a view showing the base 140 in the second embodiment as seen from a top thereof.

In the present embodiment, the above-ground section 142 of the base 140 is constituted by a plurality of above-ground blocks 143 which are coupled to each other. In the example shown in FIG. 7, three above-ground blocks 143 are piled up, and the adjacent above-ground blocks 143 are coupled to each other at the sides thereof by using coupling members 146. As shown in FIG. 8, the two coupling members 146 are arranged side by side at each of the sides of the above-ground blocks 143 so that the adjacent above-ground blocks 143 are tightly and closely coupled.

Other structures in the present embodiment are generally the same as those in the above-described first embodiment.

Since the above-ground section 142 of the base 140 in the present embodiment is formed by coupling a plurality of blocks to each other tightly and closely, the above-ground section 142 can be considered to have a structure which is generally identical to that of the above-ground section 142 in the first embodiment which is integrally formed as a unit.

Therefore, in the present embodiment also, when the height $H_1$ of the above-ground section 142 of the base 140 is set to be 5 m or less and also the average horizontal cross sectional area $A_1$ of the above-ground section 142 is set to be 3 $m^2$ or more, then vibration of the components on the base 140 can be effectively suppressed. Moreover, it is preferred to control the positions of the components disposed on the base 140, the weights of the components, and the like so that the top portion (upper surface $S_1$) of the base 140 in operation has acceleration of 0.3 Gal or less at a frequency of 5 Hz or more in all of the X-axis, Y-axis, and Z-axis directions, on the basis of the rms value (root-mean-square value) obtained by a ⅓ octave-band peak hold analysis of a 60-second sampling data.

Third Embodiment

In a third embodiment of the present invention, the same members as or similar members to those in the above-described first embodiment are designated with the same reference numbers, and the detailed descriptions thereof are omitted below.

Figure 9:
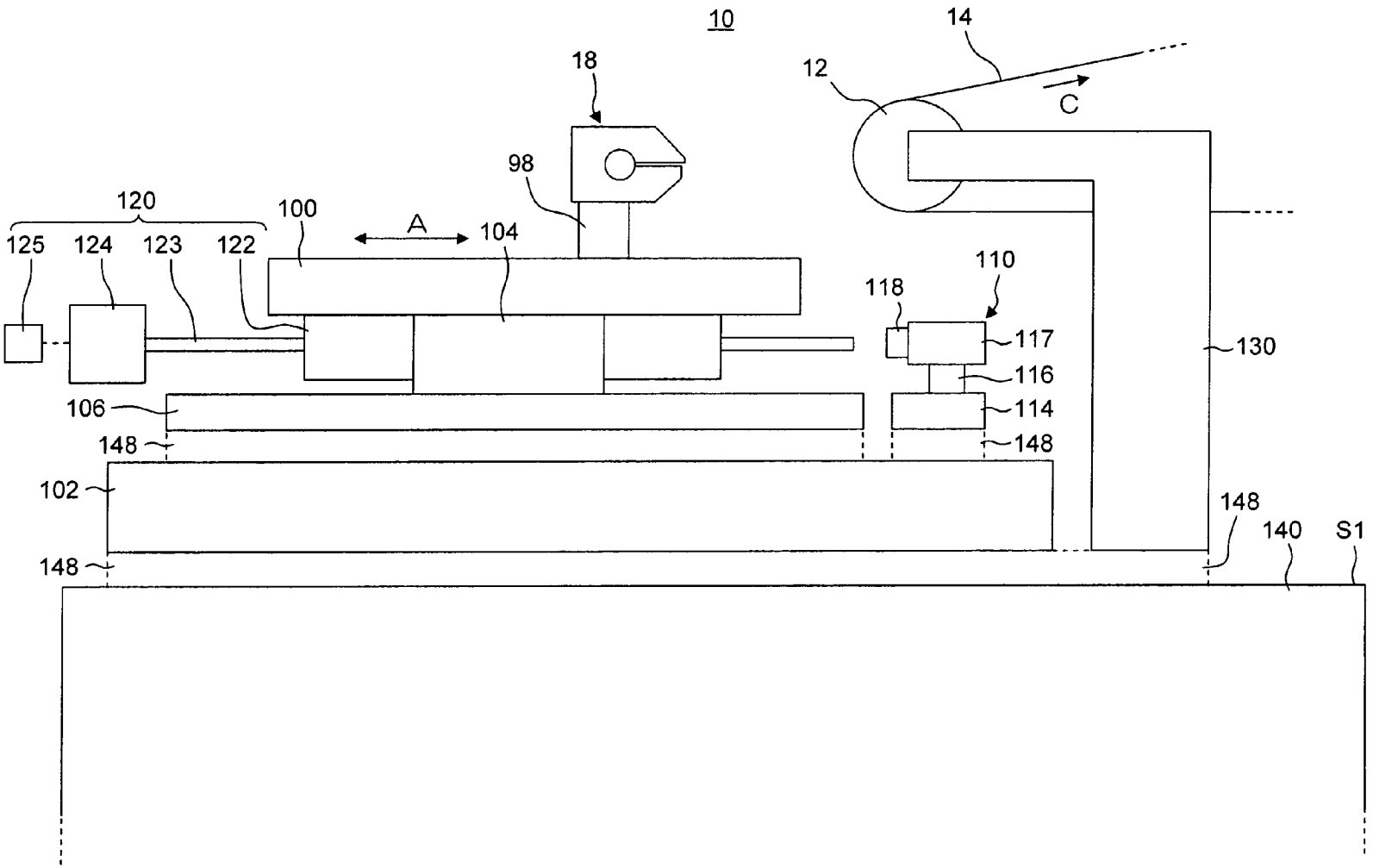
FIG. 9 is a view showing the structure of a die coater and a backup roller in a third embodiment as seen from a side thereof.

FIG. 9 is a view showing a structure of the die coater 18 and the backup roller 12 in the third embodiment as seen from a side thereof.

In the present embodiment, a vibration isolation apparatus or a vibration damping apparatus 148 is installed between the die coater 18 and the base 140 (for example, between the lower pedestal 102 and the base 140, and/or between the lower pedestal 102 and the slide guide sections 106). Also, another vibration isolation apparatus or another vibration damping apparatus 148 is installed between the first stopper 110 and the base 140 (for example, between the lower pedestal 102 and the base 140, and/or between the stopper pedestal 114 and the lower pedestal 102). Furthermore, another vibration isolation apparatus or another vibration damping apparatus 148 is installed between the backup roller 12 and the base 140 (for example, between the roller pedestal 130 and the base 140). When the vibration isolation apparatus or the vibration damping apparatus 148 is installed directly on the base 140, "the vibration isolation apparatus or vibration damping apparatus 148 between the base 140 and the lower pedestal 102" and "the vibration isolation apparatus or vibration damping apparatus 148 between the base 140 and the roller pedestal 130" may be integrally provided as a unit or individually provided as separate units.

Other structures in the present embodiment are generally the same as those in the above-described first embodiment.

The combination of the vibration isolation apparatus or vibration damping apparatus and the conventional base also suppresses vibration of a coating apparatus to some degree; however, the vibration suppressed by this system is within a different frequency range from that suppressed by the slot die coater type coating system 10 including the base 140 according to the present embodiment. A typical vibration isolation apparatus or vibration damping apparatus can suppress or damp the vibration within a high frequency range well, but tends to cause natural vibration in the apparatus itself, which somewhat reduces its capability to suppress or damp vibration within a low frequency range. To the contrary, according to the base 140 in the present embodiment, even the vibration within a low frequency range can be effectively suppressed.

Therefore, the combination of a vibration isolation apparatus or vibration damping apparatus and the base 140 as in the present embodiment enables an effective suppression of vibration within a wide frequency range, which achieves a suppression of vibration for an extremely high total performance.

Next, a specific structure of an optical film which can be achieved by embodiments of the present invention is explained below.

Optical Compensation Sheet for LCD

A liquid crystal display in which an optical compensation sheet having an optically anisotropic layer of a discotic compound formed on a transparent supporting medium (the web 14) of cellulose acylate film is directly used as a protective film for a polarizer, is explained below; however, the optical films which can be achieved according to embodiments of the present invention are not limited to the examples described below.

The discotic compounds are described in detail in Japanese Patent Application Laid-Open Nos. 7-267902, 7-281028, and 7-306317. According to these publications, the optically anisotropic layer is formed of a compound which contains discotic structural units. That is, the optically anisotropic layer is a layer of a low molecular weight liquid crystal discotic compound such as monomers, or a layer of polymers which are produced by polymerization (curing) of a polymerizable liquid crystal discotic compound.

A cellulose acylate film can be preferably used as a supporting medium (the web 14) of the oriented film. An example of the cellulose acylate film is described in Japanese Patent Application Laid-Open No. 9-152509 in detail. More specifically, an oriented film can be arranged on a cellulose acylate film or on an undercoating layer which is applied onto a cellulose acylate film, and functions to define an orientation direction of a liquid crystal discotic compound which is applied onto the oriented film. The oriented film may be any layer which defines an orientation of an optically anisotropic layer. Preferably, the polymer used for the oriented film and the liquid crystal compound of the optically anisotropic layer are chemically bound to each other through the interfaces of these layers.

Cellulose acylate films can be used for optical compensation sheets which have basic structures described in detail in Japanese Patent Application Laid-Open Nos. 8-5837, 7-191217, 8-50206, and 7-281028. An optical compensation sheet having a cellulose acylate film and an optically anisotropic layer applied thereon is one example of sheet, and the optically anisotropic layer of the sheet is formed of a compound having discotic structural units. As an example of application to an LCD, it is preferred to attach the optical compensation sheet to one side of a polarizer via an adhesive, or to attach the optical compensation sheet to one side of a polarizing element via an adhesive as a protective film. Preferably, the optically anisotropic element has at least a discotic structural unit (a discotic liquid crystal is preferred).

The above optical compensation sheet to which a cellulose acylate film is applied can be manufactured by a method such as those described in detail in Japanese Patent Application Laid-Open Nos. 9-73081, 8-160431, and 9-73016 for example; however, the method is not limited to those.

Application Method of Optical Compensation Sheet for LCD

Next, applications of a cellulose acylate film to a panel are explained below. The applications are described in detain in Japanese Patent Application Laid-Open Nos. 8-95034, 9-197397, and 11-316378. The optical compensation sheets described in the above documents are advantageously used in a liquid crystal display, particularly in a transmissive liquid crystal display. A transmissive liquid crystal display includes a liquid crystal cell and two polarizers which are disposed on both sides of the liquid crystal cell. The liquid crystal cell carries a liquid crystal between two electrode substrates. In such a transmissive liquid crystal display, a optical compensation sheet may be interposed between the liquid crystal cell and one of the polarizers, and two optical compensation sheets may interposed between the liquid crystal cell and both of the polarizers. The liquid crystal cell is preferably a VA mode liquid crystal cell, a TN mode liquid crystal cell, or an OCB mode liquid crystal cell.

Anti-Glare Film, Anti-Reflection Film

The cellulose acylate film can be also preferably applied to an anti-glare film (anti-dazzle film) and an anti-reflection film. In order to improve the visibility of a flat panel display such as LCD, PDP, CRT, and EL, one of or both of an anti-glare layer and an anti-reflection layer is formed on one of or both of the surfaces of a cellulose acylate film. Films having such a function are sometimes called an anti-glare film or an anti-reflection film, and a film having both of the functions is sometimes called an anti-glare and anti-reflection film. Typically, an anti-glare film is constituted by a transparent supporting medium and an anti-glare layer. In an anti-reflection film, an anti-reflection layer which is constituted by a single or multiple optical interference layers is provided with the transparent supporting medium as the outermost surface, and also a hard coat layer and/or an anti-glare layer are interposed between the supporting medium and the light interference layer(s) as needed.

The supporting medium is preferably a cellulose acylate film for an LCD application, and particularly cellulose acetate is preferred. When an anti-glare film and/or an anti-reflection film according to an embodiment of the present invention are used for an LCD, the film may be arranged on an outermost surface of a display or at an interface between the air in an inner side of the display, by using an adhesive layer formed on a surface of the film, for example. Since cellulose triacetate is used for a protective film which protects a polarizing device of a polarizer, it is preferable to use an anti-glare film and/or an anti-reflection film according to embodiments of the present invention as the protective film, in terms of cost and thinning of the display.

The anti-glare and anti-reflection film according to embodiments of the present invention may include a hard coat layer as needed. The compound used to form the hard coat layer is preferably a polymer which has a main chain of saturated hydrocarbon or polyether, and preferably has a cross linked structure. In order to obtain a polymer having a cross linked structure, a monomer having two or more ethylenically unsaturated groups is preferably cross linked by ionizing radiation or heat.

Various approaches for providing an anti-glare property to a film are disclosed in patent application publications, including: a method for forming an anti-glare layer having a projection-recess (concavo-convex) surface by dispersing matte particles which have a particle diameter for scattering visible light into a binder; a method for forming a projection-recess (concavo-convex) profile onto a surface of a supporting medium by embossing or sand blasting; and a method for forming a projection-recess (concavo-convex) profile onto a surface by using a phase separation structure of a coating composition. Typically, the method for dispersing matte particles into a binder is practically used.

In forming an anti-glare layer, in order to provide an anti-glare property by forming a projection-recess (concavo-convex) surface, fine particles (matting agent) of a resin or an inorganic compound are used in addition to a binder of a resin compound. The fine particles preferably have a mean particle diameter of 1.0 to 10.0 μm, more preferably 1.5 to 5.0 μm. Also, the fine particles preferably contain fine particles which have a particle diameter less than a binder film thickness of the anti-glare layer at a ratio of less than 50% in total. The particle diameter distribution of the fine particles can be measured by using Coulter Counter technique, and can be converted into a particle number distribution for examination. The anti-glare layer preferably has a film thickness of 0.5 to 10 μm, more preferably 1 to 5 μm.

In terms of film hardness and transparency, the resin binder for forming an anti-glare layer is preferably the material which is used to form the above hard coat layer. When an anti-reflection layer is combined with an anti-glare layer, a monomer having a high refractive index or inorganic fine particles having a high refractive index may be used with the above-described hard coat material. In this way, an anti-reflection property thereof can be improved, and for example, a refractive index of the layer can be increased to 2.00 (from 1.50).

When a projection-recess (concavo-convex) profile is provided to a surface of a supporting medium by embossing, the surface projection-recess profile is preferably formed after all of the plurality of optical interference layers are formed. If a plurality of optical interference layers are formed by wet coating after the surface projection-recess profile is formed, a coating solution remains in the recess part of the profile to cause each layer to have an uneven film thickness, and a considerable degrade of its anti-reflection property is caused, which is not preferred. Embossing after the formation of all of the optical interference layers allows the optical interference layers to have a substantially uniform film thickness. The term "substantially uniform" as used herein means that the uniformity is within ±3% of the central film thickness.

The anti-reflection film is configured to have a single layer of a low refractive index layer or multi layers of a low refractive index layer and a high refractive index layer so as to be provided with a film thickness, a refractive index, and a layer structure which are designed on the basis of a principle of light interference caused by an optical film. The term "a low refractive index layer" and "a high refractive index layer" used herein mean a layer having a refractive index which is lower than that of a supporting medium and a layer having a refractive index which is higher than that of a supporting medium respectively, and both of the layers have a film thickness which is equal to or less than the order of the wavelength of a target light of the anti-reflection property. Such a film having an extremely small film thickness is called an optical thin film, and is practically applied to various optically functional layers such as an anti-reflection film or a reflection film.

A low refractive index layer having a refractive index of 1.30 to 1.49 can be selected as a material which is well balanced in terms of the film hardness and the refractive index. Specifically, as disclosed in Japanese Patent Application Laid-Open Nos. 11-38202 and 11-326601, a low refractive index layer having air gaps between fine particles which have a too small particle diameter to scatter light, and a fluorine containing compound which is cross linked by heat or ionizing radiation are preferably used.

Similarly, the high refractive index layer is formed of a material which can be preferably used to increase the refractive index of the above-described anti-glare layer. The layer preferably has a refractive index within a range of 1.70 to 2.20, and a film thickness within 5 to 300 nm.

Each of the hard coat layer, the anti-glare layer, and the anti-reflection layer can be formed by coating methods such as a dip coating, an air knife coating, a curtain coating, a roller coating, a wire bar coating, a gravure coating, a micro-gravure coating, or an extrusion coating (U.S. Pat. No. 2,681,294). Two or more layers may be simultaneously coated. Methods for a simultaneous coating are described in U.S. Pat. Nos. 2,761,791, 2,941,898, 3,508,947, 3,526,528, and "Coating Engineerings", by Yuji Harasaki, p. 253, Asakura Publishing Co., Ltd. (1973).

Japanese Patent Application Laid-Open No. 2003-149413 describes a light diffusion film in which a light diffusion layer containing light-transmissive fine particles in a light-transmissive resin is provided on a cellulose acetate film having an acetification degree of 59.0 to 61.5%. The cellulose acetate film has a thickness of 20 to 70 μm, a cutoff value of 0.8 mm per length of 100 mm, and a mean surface roughness Ra of 0.2 μm or less. This light diffusion film can be used for a liquid crystal display for a high quality display with little defects due to an angular change such as decreased contrast, gradation or black and white reverse, and hue change. Embodiments of the present invention can be applied to such a light diffusion film.

In an anti-glare film or an anti-reflection film according to an embodiment of the present invention, before or after the formation of the anti-glare film or the anti-reflection film, the back surface of the supporting medium may be subjected to saponification by using some device, so that the film can be directly adhered to one or both of the surfaces of a polarizer as a protective film in manufacturing the polarizer which is used in various applications such as an LCD.

In particular, in a case where a phase difference film is interposed between each polarizer and a cell in which liquid crystal is enclosed for a wide angular field of view of an LCD, an anti-glare film or an anti-reflection film can be adhered to one surface of one polarizer which is on the view side of the polarizers being mounted on both side of the cell, as a protective film between the polarizer and the air. Moreover, a phase difference film can be adhered to the other surface of the polarizer as a protective film between the polarizer and the cell. Such a polarizer of this configuration can provide properties, such as wide angular field of view and low reflectivity, without increasing its thickness compared to conventional polarizers, and is extremely preferable to high performance LCD applications.

A multi-layer film having a plurality of transparent thin films which are formed of inorganic compounds (such as a metallic oxide) having different refractive indexes may be formed by methods including: a chemical vapor deposit (CVD) method; a physical vapor deposition (PVD) method;

and a sol-gel method using a metal compound such as metal alkoxides. In such a sol-gel method, a post treatment (e.g., ultraviolet irradiation as disclosed in Japanese Patent Application Laid-Open No. 9-157855, or plasma treatment as disclosed in Japanese Patent Application Laid-Open No. 2002-327310) is performed after a film of colloidal metal oxide particles is formed. Meanwhile, various types of an anti-reflection film which is formed by stacking up a plurality of thin films of a matrix dispersion of inorganic particles, have been proposed as highly productive anti-reflection films.

An anti-reflection film which is formed by one of the above-described methods and is constituted by an anti-reflection layer having a fine projection-recess profile and an anti-glare property, is also one example.

Layer Structure of Coating-Type Anti-Reflection Film

An anti-reflection film having a middle refractive index layer, a high refractive index layer, and a low refractive index layer (outermost layer) in order on one surface of a substrate is designed to have refractive indexes which satisfy the following relationship: "the high refractive index layer has a refractive index larger than that of the middle refractive index layer, and the middle refractive index layer has a refractive index larger than that of the transparent supporting medium, and the transparent supporting medium has a refractive index larger than that of the low refractive index layer". Moreover, a hard coat layer may be interposed between the transparent supporting medium and the middle refractive index layer. Furthermore, the coating-type anti-reflection film may include a middle refractive index hard coat layer, a high refractive index layer, and a low refractive index layer. Each layer of such a film may be provided with another property, and examples of such a layer include a low refractive index layer having antifouling property, and a high refractive index layer having antistatic property (see Japanese Patent Application Laid-Open Nos. 10-206603 and 2002-243906, for example).

An anti-glare and anti-reflection film in which an anti-glare layer and a low refractive index layer are superimposed on one surface of a substrate is designed to have refractive indexes which satisfy the following relationship: "the anti-glare layer has a refractive index larger than that of the low refractive index layer". Moreover, a hard coat layer may be interposed between the transparent supporting medium and the anti-glare layer.

A transparent-type anti-reflection film in which a hard coat layer is superimposed on one surface of a substrate and a low refractive index layer is superimposed on the hard coat layer, is designed to have refractive indexes which satisfy the following relationship: "the anti-glare layer has a refractive index larger than that of the low refractive index layer". Moreover, a hard coat layer may be interposed between the transparent supporting medium and the anti-glare layer. Furthermore, an anti-glare and anti-reflection film in which an anti-glare layer is superimposed on one surface of a substrate and a high refractive index layer and a low refractive index layer are superimposed on the anti-glare layer, is designed to have refractive indexes which satisfy the following relationship: "the high refractive index layer has a refractive index larger than that of the transparent supporting medium, and the transparent supporting medium has a refractive index larger than that of the low refractive index layer". Alternatively, an anti-glare and anti-reflection film in which a hard coat layer is superimposed on one surface of a substrate and a high refractive index layer and a low refractive index layer are superimposed on the hard coat layer, is designed to have refractive indexes which satisfy the following relationship: "the high refractive index layer has a refractive index larger than that of the transparent supporting medium and the transparent supporting medium has a refractive index larger than that of the low refractive index layer".

A layer having a high refractive index in an anti-reflection film is formed of a curable film which contains at least a matrix binder and ultrafine particles of a high refractive index inorganic compound having a mean particle diameter of 100 nm or less. In stacking up the layers, the middle refractive index layer is controlled to have a refractive index between a refractive index of the low refractive index layer and a refractive index of the high refractive index layer. The low refractive index layer is preferably formed as an outermost layer which is superimposed on the high refractive index layer in series and has scratch abrasion resistance and antifouling property.

Other Layer in Anti-Reflection Film

Furthermore, a hard coat layer, a forward scattering layer, a primer layer, an antistatic layer, an undercoat layer, a protective layer, and the like may be provided in an anti-reflection film.

Hard Coat Layer

A hard coat layer is formed on a transparent supporting medium to impart a physical hardness to the anti-reflection film. It is particularly preferred to interpose the hard coat layer between the transparent supporting medium and the high refractive index layer. The high refractive index layer may function as a hard coat layer. The hard coat layer also may include particles having a mean particle diameter of 0.2 to 10 μm so as to have an anti-glare function (which is explained later) and function as an anti-glare layer. The hard coat layer may be appropriately designed to have a thickness depending on an application.

Forward Scattering Layer

A forward scattering layer is formed in the case the resulting anti-reflective film is applied to a liquid crystal display in order to improve its angular field of view characteristic when an angle of view is inclined upward, downward, and to left direction and right directions. The hard coat layer may include fine particles having different refractive indexes so as to function as a forward scattering layer. Examples of the forward scattering layer can be found in Japanese Patent Application Laid-Open No. 11-38208 in which a forward scattering coefficient is specified, Japanese Patent Application Laid-Open No. 2000-199809 in which a relative refractive index between a transparent resin and fine particles is specified within a certain range, and Japanese Patent Application Laid-Open No. 2002-107512 in which a haze value is defined to be 40% or more.

Anti-Glare Function

The anti-reflection film may have an anti-glare function for scattering an external light. The anti-glare function can be obtained by forming a projection-recess (concavo-convex) profile on a surface of the anti-reflection film. The projection-recess profile may be formed on a surface of the anti-reflection film by any method which achieves the surface profile well.

The above-described slot die coater type coating system 10, which is particularly effective in coating a thin film, can be preferably applied to lines for manufacturing an optical film by using a wet coating amount of 20 ml/m$^2$ or less (a film thickness at the time coating is 20 μm or less), and by using a wet coating amount of 10 ml/m$^2$.

The slot die coater type coating system 10 is desirably installed in a clean atmosphere such as a clean room. The cleanliness of the atmosphere is preferably of class 1000 or less, more preferably of class 100 or less, and further preferably of class 10 or less.

In embodiments of the present invention, the number of coating layers formed by applying a coating solution is not limited to one, and embodiments of the present invention can also be applied to a simultaneous multi-coating method as needed.

As described above, in each of the above-mentioned embodiments of the present invention, the above-ground section 142 of the base 140 having a height $H_1$ which is set to be relatively low and the average of the horizontal cross sectional area $A_1$ which is set to be relatively large, enables an effective suppression of vibration caused in components such as the die coater 18 on the base 140. This reduces surface defects, such as stepped unevenness, of a coating film which is formed on the web 14 by the die coater 18, and provides a high quality coating film.

While the above-mentioned embodiments of the present invention have been illustrated, various modifications such as design changes may be added or various known elements may be applied to embodiments of the present invention on the basis of the knowledge of those skilled in the art, and such various aspects also can be within the scope of the present invention.

For example, in the above embodiments, an extrusion type die coater is used; however, the present invention is not limited to this type, and may be applied to general coating apparatuses.

In the above embodiments, the combination of the ball screw 123 and the servomotor 124 forms the driving device 120; however, the driving device 120 may have other configurations as far as it causes the movable table 100, which fixedly supports the die coater 18, to move to a desired position. For example, the driving device 120 may have a configuration in which a moving device such as a hydraulic power unit presses the stopper receiving section 122 or the movable table 100 to cause the slide sections 104 to slide on the slide guide sections 106. In such a case, the moving device such as a hydraulic power unit is preferably arranged on the opposite side of the stopper receiving section 122 to the first stopper 110 with respect to the moving direction of the die coater 18 (the left side of FIG. 4).

The backup roller 12, the die coater 18, and the decompression chamber 26 may be arranged in any positional relationship relative to each other in the slot die coater type coating system 10 as far as a coating solution can be appropriately applied onto the web 14. For example, the angle at which a coating solution is discharged from the die coater 18 toward the web 14, the cross sectional shape of the manifold 22, the state of the web 14 wound on the backup roller 12, the positional relationships between the wound web 14 on the backup roller 12 and the die coater 18 and between the wound web 14 and the decompression chamber 26, an amount of the overbite, and the like, may be conveniently controlled.

A coating solution may be supplied to the manifold 22 by any method as far as the coating solution is appropriately supplied to the manifold 22. For example, not only the approach in which a coating solution is supplied through an opening at one end of the manifold 22 (see FIG. 3), but also an approach in which a coating solution is supplied through an opening at the central part of the manifold 22, or an approach in which, with plugs being provided at the both ends of the manifold 22 for preventing a leak of a coating solution, a new coating solution is supplied through an opening at one end of the manifold 22 and a part of the discharged coating solution is returned back to the other end for circulation, may be used.

The cross sectional shape of the manifold 22 is not limited to the generally circular one as shown in FIG. 2, but may be a semi-circular shape, a rectangular shape such as trapezoidal shape, or other shapes similar to these.

In the above embodiments, the air inlet port 35 and the blower 30 are automatically controlled by the controller 38, but these components may be manually controlled by a user as needed.

In the above embodiments, a coating film is formed on the web 14 as a single layer; however, a coating film having a plurality of layers including a functional film, such as an anti-glare (anti-dazzle) layer or an anti-reflection layer, may be formed. In cases where a coating film having a plurality of layers is formed, coating solutions for the plurality of layers may be applied onto the web 14 in series, or coating solutions for the plurality of layers may be simultaneously applied onto the web 14. When a film having more than two layers is formed on the web 14 (e.g. substrate and film) by serial coatings, the serial coatings are preferably performed in series in terms of productivity, that is, preferably a winding step for each layer (coating film) is eliminated except for that for the last layer, and a coating step and a drying step are repeatedly performed for each layer and a winding step is finally performed to collect the layers.

EXAMPLE

Examples using the above-described slot die coater type coating system 10 according to the first embodiment are explained below, but the present invention is not limited to the following examples.

Example 1

First, an anti-glare film was formed as an undercoating.

A coating solution was prepared as follows. 75 g (gram) of a mixture of dipentaerythritol pentaacrylate and dipentaerythritol hexaacrylate (DPHA, manufactured by Nippon Kayaku Co., Ltd.) and 240 g of a coating solution for a hard coat containing a dispersion of zirconia ultrafine particles having a particle diameter of about 30 nm (DeSolite Z-7401, manufactured by JSR CORPORATION), were dissolved into 104 g of a solvent mixture of methyl ethyl ketone/cyclohexanone (54/46% by weight).

Then, 10 g of a photopolymerization initiator (IRGACURE 907, manufactured by Ciba Fine Chemicals Co., Ltd.) was added to the solution that was obtained as described, and the mixed solution was stirred so that the photopolymerization initiator was dissolved in the solution. After that, 0.93 g of a fluorine surfactant which is constituted by a methyl ethyl ketone solution having 20% by weight of fluorine containing oligomer (MEGAFAC F-176PF, manufactured by Dainippon Ink and Chemicals Incorporated) was further added to the solution (coating film that is acquired by applying the solution obtained as described above and curing it with ultraviolet light, had a refractive index of 1.65).

Then, 29 g of a dispersion liquid was prepared and was added to the above-described solution as follows: 20 g of cross-linkage polystyrene particles which had a number mean particle diameter of 2.0 μm and a refractive index of 1.61 (SX-200HS, manufactured by Soken Chemical & Engineering Co., Ltd.) was added to 160 g of a solvent mixture of methyl ethyl ketone/cyclohexanone (54/46% by weight), and the mixed solution was stirred so as to disperse the cross-linkage polystyrene particles by using a high speed dispersion mixer at 5000 rpm for one hour; then, the mixed solution was filtered by polypropylene filters that have pore sizes of 10 μm, 3 μm and 1 μm respectively (PPE-10, PPE-03 and PPE-01 respectively, all manufactured by FUJIFILM Co.), so that the above dispersion liquid was obtained; then, the dispersion liquid was added to the above-mentioned solution, and it was stirred. After that, the resulting solution was filtered by a polypropylene filter having a pore size of 30 μm, so that a coating solution for an anti-glare layer which had a viscosity of 8 mPa·s/$m^2$ and a surface tension of 30 mN/m was obtained.

The coating solution obtained in this way was applied onto the web 14 by using a bar coater to form a coating film on the web 14 so that the coating film had a wet film thickness of 8 μm, an amount of the coating solution applied on the web 14 is 8 mL/$m^2$, and the coating width is 1440 mm. At this point, the web 14 was conveyed at a speed of 10 m/min. Then the web 14 provided with the coating solution applied thereon as descried above was wound into a roll by using a winder 82.

Next, a coating solution for anti-reflection film was prepared (a preparation of a coating solution for low refractive index layer). The coating solution for anti-reflection film was prepared by adding 8 g of MEK-ST (a methyl ethyl ketone dispersion having a mean particle diameter of 10 nm to 20 nm and a $SiO_2$ sol with solid content concentration of 30% by weight, manufactured by Nissan Chemical Industries, Ltd.), 188 g of methyl ethyl ketone, and 12 g of cyclohexanone, to 93 g of a methyl ethyl ketone solution having a refractive index of 1.42 and containing a thermally cross linkable fluorine-containing polymer of 6% by weight (JN-7228, manufactured by JSR CORPORATION), by stirring the mixed solution, and then by filtering the resulting dispersion liquid by using a polypropylene filter having pore sizes 1 μm (PPE-01). The obtained coating solution for anti-reflection film had a viscosity of 1 mPa·s and a surface tension of 24 mN/m.

The coating solution for anti-reflection film obtained in this way was applied on the web 14 by using the die coater 18 to form a coating film on the web 14, so that the coating film had a wet film thickness of 6 μm, an amount of the coating solution applied on the web 14 was 6 mL/$m^2$, and the coating width was 1490 mm.

The web 14 in which the above anti-glare layer was formed on a FUJITAC layer having a width of 1470 mm was adopted, and the web 14 was conveyed at a speed of 10 m/min. After the coating solution for an anti-reflection film was applied to the web 14 as described above, the web 14 was wound into a roll by using the winder 82.

The above-described formation of the coating film was performed by using the die coater 18 and the backup roller 12 mounted on the base 140 which had the following configuration. More specifically, the base 140 had the underground section 144 which was formed of a concrete member having a size of 5 m×6 m×2 m (width×length×depth ($H_2$)). The base 140 also had the above-ground section 142 which was formed of a reinforced concrete member (which was a body) having a cross sectional area of 3 $m^2$ which was piled up on the central part of the underground section 144 and was coupled to the underground section 144. Around the body having a cross sectional area of 3 $m^2$, reinforced concrete blocks were further piled up and coupled to the body so as to adjust the average cross sectional area of the above-ground section 142.

As for the vibration that was applied to the base 140 and the components on the base 140, general external vibration was expected. Specifically, in order to generate the expected vibration, a 10-ton truck ran over a predetermined bump on an asphalt pavement which was located far from the base 140 by about 20 m. The generated vibration was controlled to have a frequency from 5 Hz to 50 Hz on the ground (ground surface) adjacent to the base 140, and have the amplitude on the order of 5 μm.

Under the above-described conditions, the height $H_1$ and the average of the horizontal cross sectional area $A_1$ of the above-ground section 142 of the base 140 were varied, to obtain the results shown in the following Table 1.

TABLE 1

| | Height Above Ground of Upper portion of Base | Cross Sectional Area Above Ground (Average) | Maximum Natural Frequency | Peak Vibration of 5 Hz or More (X, Y, Z) | Rate of Film Thickness Change Caused by Stepped Unevenness | Surface Profile with Stepped Unevenness |
|---|---|---|---|---|---|---|
| No. 1 | 0.0 m | 3 $m^2$ | 250 Hz | 0.15 Gal, 0.10 Gal, 0.10 Gal | 0.3% | Very Good |
| No. 2 | 2.5 m | 3 $m^2$ | 200 Hz | 0.15 Gal, 0.15 Gal, 0.10 Gal | 0.5% | Good |
| No. 3 | 5 m | 3 $m^2$ | 140 Hz | 0.30 Gal, 0.20 Gal, 0.10 Gal | 0.6% | Good |
| No. 4 | 7.5 m | 3 $m^2$ | 70 Hz | 0.40 Gal, 0.45 Gal, 0.25 Gal | 1.4% | Poor |
| No. 5 | 2.5 m | 2 $m^2$ | 110 Hz | 0.35 Gal, 0.30 Gal, 0.25 Gal | 1.0% | Poor |
| No. 6 | 2.5 m | 4 $m^2$ | 290 Hz | 0.15 Gal, 0.15 Gal, 0.10 Gal | 0.3% | Very Good |

In the above Table 1, the "Height Above Ground of Upper portion of Base" means a height $H_1$ of the above-ground section 142 of the base 140, the "Cross Sectional Area Above Ground (Average)" means an average horizontal cross sectional area $A_1$ of the above-ground section 142, and the "Maximum Natural Frequency" means the natural frequency which is the maximum among the natural frequencies of the base 140. The "Peak Vibration of 5 Hz or More (X, Y, Z)" shows accelerations at the top portion $S_1$ of the above-ground section 142 when a vibration of 5 Hz or more is applied to the base 140, and the accelerations in X direction, Y direction, and Z direction which are perpendicular to each other are listed in series. The "Rate of Film Thickness Change Caused by Stepped Unevenness" shows a rate of a film thickness change as measured when a coating film formed on the web 14 is dried, and on the basis of a reference film thickness of 90 nm, a maximum difference from the reference film thickness is indicated by percent (%). The "Surface Profile with Stepped Unevenness" shows a surface profile of a coating film which is formed on the web 14. In this Example 1, a back surface of a sample was painted all black by using a marker, and a scattering light of a white fluorescent lamp was radiated onto a front surface of the sample to visually check the surface profile. In the "Surface Profile with Stepped Unevenness" column, "Very Good" means the surface had a very good profile, and "Good" means the surface had a good profile, and "Moderate" means the surface had a moderate profile, and "Poor" means the surface had a profile with visible stepped unevenness.

The vibration (acceleration) of the base 140 was measured by using a servo accelerometer LS-10C manufactured by Rion Co., Ltd., and the data obtained using a general FFT (fast Fourier transform) was analyzed. This analysis was performed, on the basis of the rms value obtained by a ⅓ octave-band peak hold analysis of a 60-second sampling data. The maximum natural frequency of the base 140 was calculated by using a modal analysis.

The above Table 1 indicates that, when the height of the above-ground section 142 of the base 140 above the ground level was 5 m or less (see "No. 1 to No. 3 and No. 6" and "No. 4" of Table 1) and the average horizontal cross sectional area $A_1$ of the above-ground section 142 was 3 $m^2$ or more (see "No. 1 to No. 3 and No. 6" and "No. 5" of Table 1), the rate of a film thickness change of a coating film formed on the web 14 is reduced and a coating film having a good surface profile can be obtained. Also, the above Table 1 shows that, in the case where a coating film has a good surface profile (see "No. 1 to No. 3 and No. 6" of Table 1), the "accelerations at the top portion $S_1$ of the base 140" is 0.3 Gal or less in all of the X direction, the Y direction, and the Z direction. On the contrary, in the case where a coating film has visible stepped unevenness on its surface (see "No. 4 and No. 5" of Table 1), the "acceleration at the top portion $S_1$ of the base 140" is 0.3 Gal or more in the X direction, the Y direction, or the Z direction.

Moreover, in the case where a coating film has a good surface profile (see "No. 1 to No. 3 and No. 6" of Table 1), the rate of a film thickness change of the coating film is 0.6% or less, and the maximum natural frequency of the base 140 is 140 Hz or more, which is relatively high. On the contrary, in the case where a coating film has visible stepped unevenness on its surface (see "No. 4 and No. 5" of Table 1), the rate of a film thickness change of the coating film is 1.0% or more and the maximum natural frequency of the base 140 is 110 Hz or less.

Example 2

A coating film was formed on the web 14 under the similar conditions to those in Example 1.

In this Example 2, the effectiveness of the vibration isolation apparatus 148 was checked. In order to dispose the vibration isolation apparatus 148, the slot die coater type coating system 10 having the structure of FIG. 9 was used, and the "vibration isolation apparatus 148 interposed between the base 140 and the lower pedestal 102" and the "vibration isolation apparatus 148 interposed between the base 140 and the roller pedestal 130" were integrally provided as a unit. Meanwhile, in order not to dispose the vibration isolation apparatus 148, the slot die coater type coating system 10 having the structure of FIG. 4 was also used.

An active vibration isolator α2 manufactured by TOKYO-OKIKI CORPORATION was adopted as the vibration isolation apparatus 148. The vibration isolation apparatus 148 was conveniently switched between an "active mode (active vibration removal mode)" and a "passive mode (passive vibration removal mode)".

In this Example 2, the above-ground section 142 of the base 140 was maintained to have a height $H_1$ ("Height Above Ground of Upper portion of Base") of 5 m, and also the above-ground section 142 was maintained to have an average of the horizontal cross sectional area $A_1$ ("Cross Sectional Area Above Ground (Average") of 3 $m^2$.

Under the above-described conditions, the results shown in the following Table 2 were obtained.

TABLE 2

| | Height Above Ground of Upper portion of Base | Cross Sectional Area Above Ground (Average) | Vibration Isolation Apparatus | Peak Vibration of 5 Hz or More (X, Y, Z) | Rate of Film Thickness Change Caused by Stepped Unevenness | Surface Profile with Stepped Unevenness |
|---|---|---|---|---|---|---|
| No. 1 | 5 m | 3 $m^2$ | Not Included | 0.30 Gal, 0.20 Gal, 0.10 Gal | 0.6% | Good |
| No. 2 | 5 m | 3 $m^2$ | Included (Passive Mode) | 0.20 Gal, 0.10 Gal, 0.10 Gal | 0.3% | Very Good |
| No. 3 | 5 m | 3 $m^2$ | Included (Active Mode) | 0.10 Gal, 0.10 Gal, 0.10 Gal | Below 0.3% | Very Good |

In the above Table 2, the "Vibration Isolation Apparatus" shows if the vibration isolation apparatus 148 was included or not, and its vibration removal mode (active mode or passive mode) if included.

This Example 2 also shows that, as shown in the above Table 2, in every case which satisfied the conditions that the height of the above-ground section 142 of the base 140 above the ground level was 5 m or less and the average horizontal cross sectional area $A_1$ of the above-ground section 142 was 3 $m^2$ or more (see "No. 1 to No. 3" of Table 2), the rate of a film thickness change of a coating film formed on the web 14 was reduced and a coating film having a good surface profile could be obtained. Compared to the case where the vibration isolation apparatus 148 was not included (see "No. 1" of Table 2), in the case where the vibration isolation apparatus 148 was included (see "No. 2 and No. 3" of Table 2), the "acceleration at the top portion $S_1$ of the base 140" was more effectively reduced, and the rate of a film thickness change of a coating film formed on the web 14 was reduced and a coating film having a good surface profile could be obtained. Also, the vibration isolation apparatus 148 in an active mode could effectively reduce the "acceleration at the top portion $S_1$ of the base 140", and could more effectively reduce the rate of a film thickness change of a coating film, compared to that in a passive mode.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A coating method comprising the steps of:

preparing a medium; and forming a coating film on the medium by using a coating apparatus, said coating apparatus comprising a base for supporting a slot die, wherein the base has an above-ground section having a height of not more than 5 m from a ground level, and a mean cross sectional area of not less than 3 $m^2$ in terms of a horizontal direction, wherein a top portion of the base shows acceleration of not more than 0.3 Gal at a frequency of not less than 5 Hz according to a root-mean-square value obtained by a ⅓ octave-band peak hold analysis of a 60-second sampling data;

the base is made of concrete or reinforced concrete; and further comprising at least one of a vibration damping apparatus and a vibration isolation apparatus which is interposed between the slot die and the base.

2. A method for manufacturing an optical film, comprising the steps of:

forming a coating film on a medium by using a coating apparatus comprising a base for supporting a slot die, wherein the base has an above-ground section having a height of not more than 5 m from a ground level, and a mean cross sectional area of not less than 3 $m^2$ in terms of a horizontal direction, wherein a top portion of the base shows acceleration of not more than 0.3 Gal at a frequency of not less than 5 Hz according to a root-mean-square value obtained by a ⅓ octave-band peak hold analysis of a 60-second sampling data;

the base is made of concrete or reinforced concrete; and further comprising at least one of a vibration damping apparatus and a vibration isolation apparatus which is interposed between the slot die and the base; and manufacturing an optical film including the coating film.

3. The coating method according to claim 2, wherein the optical film is an anti-reflection film.

4. The coating apparatus according to claim 1, wherein the base supports both an applicator which includes the slot die, and a coating roll apparatus which supports a medium to which a coating solution ejected from the slot die is applied.

5. The coating apparatus according to claim 2, wherein the base supports both an applicator which includes the slot die, and a coating roll apparatus which supports a medium to which a coating solution ejected from the slot die is applied.

6. The coating apparatus according to claim 1, wherein the slot die is a die coater or a slide coater.

7. The coating apparatus according to claim 2, wherein the slot die is a die coater or a slide coater.

8. The coating method according to claim 1, further comprising the step of drying the coating film on the medium.

9. The coating method according to claim 1, wherein the cross sectional area is determined based on a dimension other than height as the cross sectional is viewed from above the base towards the ground, and the height is measured from the ground upward.

10. The coating method according to claim 1, wherein the cross sectional area is determined based on a length and width of a portion of the base that is above the ground.

* * * * *